United States Patent [19]

Worton

[11] Patent Number: 4,890,336

[45] Date of Patent: Jan. 2, 1990

[54] WELDING PROTECTED COVERALLS

[76] Inventor: Barry Worton, 72 Schooner Ave., Barnegat, N.J. 08005

[21] Appl. No.: 189,056

[22] Filed: May 2, 1988

[51] Int. Cl.[4] ..... A41D 1/06

[52] U.S. Cl. ..... 2/79; 2/81

[58] Field of Search ..... 2/79, 228, 227, 81, 2/2, 51

[56] References Cited

U.S. PATENT DOCUMENTS 3,691,564 9/1972 La Marre et al. ..... 2/81 X 4,223,064 9/1980 Ballif, III et al. ..... 2/81 X

FOREIGN PATENT DOCUMENTS 66399 12/1982 European Pat. Off. ..... 2/79

2543046 4/1977 Fed. Rep. of Germany ..... 2/79

*Primary Examiner*—Ronald Feldbaum

*Attorney, Agent, or Firm*—Charles I. Brodsky

[57] ABSTRACT

A pair of coveralls is provided with fire-proof material along the chest, arm, thigh and zipper areas in affording degrees of protection against burning and/or other injuries to a wearer during typical welding operations.

7 Claims, 1 Drawing Sheet

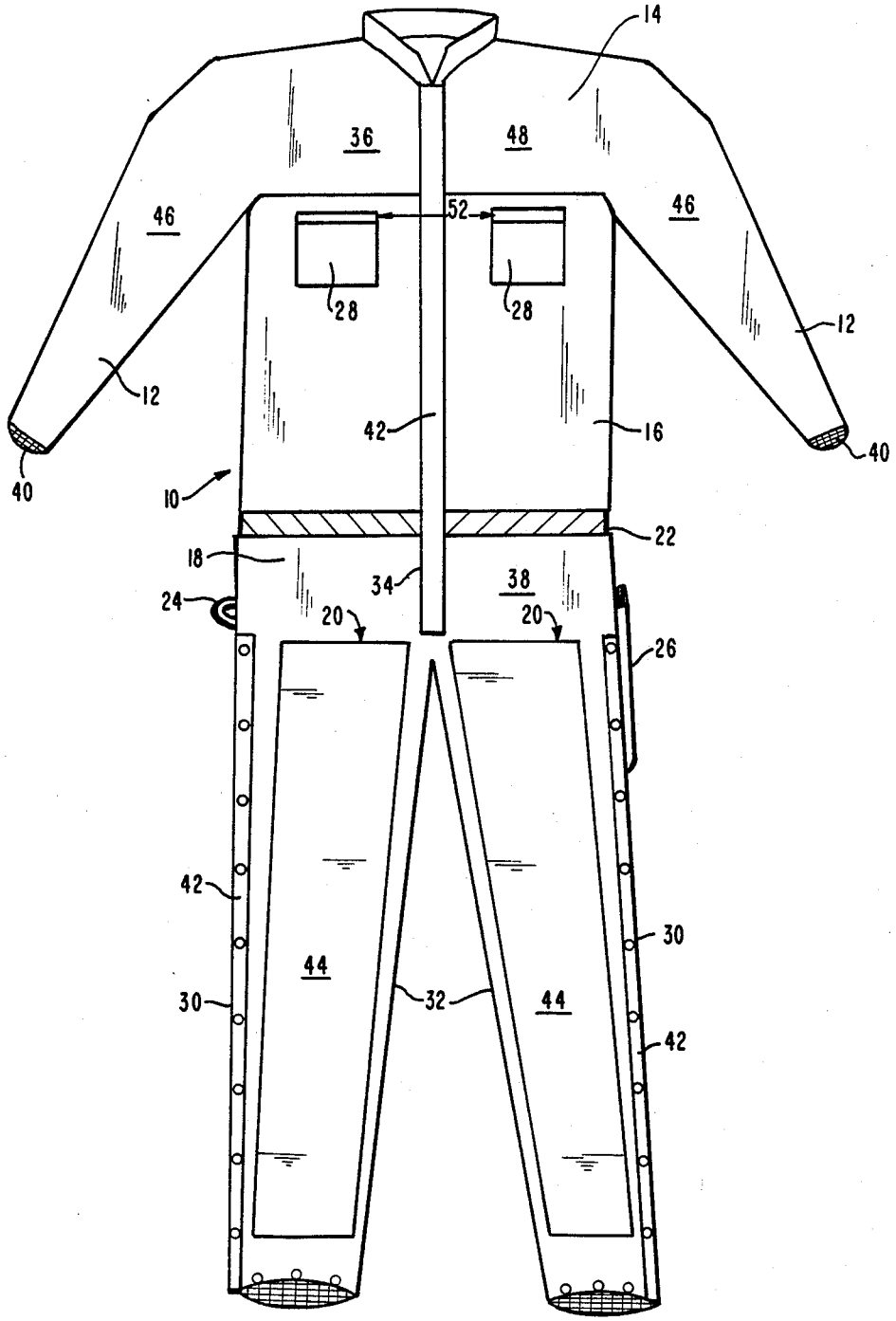
14
36
48
46
52
46
28
28
12
12
42
16
40
40
10
22
18
34
38
24
20
20
26
42
30
44
32
44
30
42

WELDING PROTECTED COVERALLS

FIELD OF THE INVENTION

This invention relates to welding operations, in general, and to a pair of coveralls affording protection to a wearer against burn and/or other injuries typically produced during welding procedures.

BACKGROUND OF THE INVENTION

As is well known and understood, coveralls are typically worn by welders and are provided with various pouches, pockets, and loops in holding the various tools and equipments utilized in such procedures. As is also well known and understood, such coveralls are generally of a relatively light-weight fabric for summer use, and are heavily insulated for winter-wearing. As is also appreciated, a welding operation is one that affords the very distinct possibility of throwing-off sparks during the procedure—which often has the tendency to burn the clothing, to at the very least damage the clothing, or to burn the individual wearing the coveralls. As will be apparent, it would be quite useful if such coveralls can be provided with a degree of protection to the wearer against these instances, while at the same time, protecting the coveralls against "burning" or "smoldering", where replacement would then be required.

SUMMARY OF THE INVENTION

As will become clear hereinafter, the apparatus of the invention comprises a pair of coveralls that is provided with fire-proof materials along the chest, arm, thigh and zipper areas in affording the protection to be described. As will be noted, it is of course possible to make the entire pair of coveralls of a fire-proof material—but that has proven to be overly costly, and not generally necessary as the sparks generated by a welding procedure have tendencies to fall more in certain, defined areas of the coveralls, as contrasted with falling at all random areas. Analysis has shown that the typical welding procedure—done either while standing, or sitting—produces far greater tendency of causing the sparks to fall in these indicated areas, as compared to the other areas of the coveralls worn. As will additionally be apparent, any available type of fire-proof material can be employed, although, in a preferred embodiment of the invention, leather, suede or other available animal skin may be utilized.

BRIEF DESCRIPTION OF THE DRAWING

These and other features of the invention will be more clearly understood from a consideration of the following description, taken in connection with the accompanying drawing which illustrates one pair of welding-protected coveralls constructed in accordance with the invention.

DETAILED DESCRIPTION OF THE DRAWING

Referring to the drawing, reference numeral 10 identifies the pair of coveralls, having areas at the arms 12 and chest 14. The torso areas are shown by the reference numerals 16, 18, with the thigh areas indicated by the reference numeral 20. The typical belt is shown by the reference numeral 22, with reference numerals 24, 26 identifying the "hammer-loop" and welding rod pouch typically employed. A pair of pockets are shown at 28, and with closure of the coveralls being by means of zippers 30 along the leg sections 32 and by a further zipper 34 extending from the neck area 36 down to the crotch area 38. When constructed for wintertime usage, the coveralls 10 are typically provided with an insulated lining, oftentimes of a "quilting" material 40.

In accordance with the present invention, welding-protective leather, suede or other fire-proof material is provided in the nature of a flap 42 over the zippers 30, 34. Also, in accordance with the invention, such similar welding-protective or other fire-proof materials are sewn at the thigh areas 20 (as indicated at 44)—and, again, sewn over the areas 12, 14 (as at 46, 48). Lastly, similar such fire-proof material (in the nature of leather, suede, animal skin, etc.) are included over the pair of pockets 28 in the coveralls (as at 52).

Analysis has shown, first of all, that the areas at the arms 12, chest 14 and legs 32 are those regions most susceptible of catching fire from sparks produced during the welding procedure. Analysis has also shown that the areas of the pockets 28 are the next most susceptible areas. The zippers 30, 34—being usually manufactured of a metal composition—have been additionally analyzed to need protection because of the ease with which heat and high temperatures travel along their lengths due to the thermal conductivity of such materials —and, therefore, protection is desired at those locations, as well.

Testing has shown that a pair of coveralls provided with such fireproof materials in the areas outlined have been quite successful in affording high degrees of protection against burn, or related, injuries that otherwise occur to on-the-job welders. Testing has also shown a marked decline in the occurrences where the coveralls employed either burned, or smoldered. Analysis showed that the leather, suede, animal-skin and other fire-proof materials adequately protected the coveralls against the sparks produced during welding—whether the coveralls that were provided with the insulation were of the lightweight, summer material, or of the insulated, winter-weight variety.

While there have been described what are considered to be preferred embodiments of the present invention, it will be readily appreciated by those skilled in the art that modifications can be made without departing from the scope of the teachings herein of providing fire-proof materials in those areas of coveralls that were most subject to spark damage during welding operations.

Thus, whereas the invention has been described in the context of overlying the coverall fabric with fire-proof material throughout the chest, arm and thigh areas, it will be appreciated that significant advantages can be had if only portions of these areas were so protected, instead of the entire area as herein described; the same will be seen to be so if the zipper overlap were provided with the fire-proof insulation only over a portion of its length, instead of over its entirety. It will be appreciated by those skilled in the art that desirous advantages would follow in both instances, equally as well—and, for at least such reason, resort should be had to the claims appended hereto for a consideration of the true scope of the invention.

I claim:

1. A welder's pair of coveralls comprising a front section having chest, arm, and leg areas and a lower torso area below said chest area, all composed of fabric material, an overlay of fire-proof material atop said fabric material at substantially the entire regions of said chest, arm and leg areas of said front section, a back section composed of fabric material, and with said back section and said lower torso area of said front section being devoid of any overlay of fire-proof material for affording protection to said front section against sparks being thrown off during welding in use of the coveralls.

2. The welder's coveralls of claim 1 wherein at least one pocket is provided in the chest area of said front section of the coveralls, and an overlay of fire-proof material is further provided atop said pocket.

3. The welder's coveralls of claim 1 wherein at least one metallic zipper closure is provided along the leg areas of said front section of the coveralls, and an overlay of fire-proof material is further provided atop said zipper.

4. The welder's coveralls of claim 1 wherein a metallic zipper closure is provided in said front section of the coveralls, extending across said chest and torso areas towards said leg areas, and an overlay of fire-proof material is further provided atop said zipper.

5. The welder's coveralls of claim 1 wherein said fire-proof material is selected of one of a leather, suede and animal-skin composition.

6. The welder's coveralls of claim 1 wherein said fabric material is additionally provided with an insulated, quilted lining.

7. A welder's pair of coveralls comprising a first section having chest, arm, torso and leg areas/composed of fabric material, an overlay of fire-proof material atop said fabric material at substantially the entire regions of said chest, arm and leg areas of said front section, a back section composed of fabric material, a pair of pockets in the chest area of said front section of the coveralls with an overlay of fire-proof material atop said pockets, a pair of metallic zipper closures along the leg areas of said front section of the coveralls with an overlay of fire-proof material atop said zippers, a metallic zipper closure in said front section of the coveralls extending across said chest and torso areas toward said leg areas with an overlay of fire-proof material atop said zipper, and with said back section and said torso area of said front section being devoid of any overlay of fire-proof material.

* * * * *